United States Patent [19]

Brookman

[11] Patent Number: 4,748,793

[45] Date of Patent: Jun. 7, 1988

[54] NEWSPAPER WRAPPING MACHINE

[75] Inventor: Anthony H. R. Brookman, Torrensville, Australia

[73] Assignee: A. H. R. Brookman Investments Pty. Ltd., Adelaide, Australia

[21] Appl. No.: 919,606

[22] Filed: Oct. 14, 1986

Related U.S. Application Data

[63] Continuation of Ser. No. 841,013, Mar. 17, 1986, abandoned, which is a continuation of Ser. No. 717,245, filed as PCT AU84/00136, Jul. 16, 1984, published as WO85/00576, Feb. 14,1985

[30] Foreign Application Priority Data

Jul. 15, 1983 [AU] Australia ..... PG0302

[51] Int. Cl.[4] ..... B65B 63/04

[52] U.S. Cl. ..... 53/119; 53/133; 53/389; 53/587; 53/593

[58] Field of Search ..... 53/118, 119, 133, 211, 53/389, 430, 593, 390, 587; 83/649, 734

[56] References Cited

U.S. PATENT DOCUMENTS

| | | | |
|---|---|---|---|
| 828,630 | 8/1906 | Scott | 53/119 |
| 1,113,823 | 10/1914 | Peterson | 53/119 |
| 2,395,125 | 2/1946 | Kile et al. | 53/593 X |
| 3,348,356 | 10/1967 | Curtis | 53/390 X |
| 3,375,635 | 4/1968 | Powell, Jr. et al. . | |
| 3,416,289 | 12/1968 | Sebelin | 53/133 X |
| 4,498,274 | 2/1985 | Vorhauer | 53/133 X |

FOREIGN PATENT DOCUMENTS

| | | | |
|---|---|---|---|
| 121185 | 3/1946 | Australia | 53/119 |
| 147136 | 2/1950 | Australia . | |
| 153317 | 11/1952 | Australia . | |
| 167316 | 12/1954 | Australia . | |
| 239865 | 11/1960 | Australia . | |
| 13107/66 | 5/1969 | Australia . | |
| 2236587 | 2/1974 | Fed. Rep. of Germany | 53/211 |
| 639748 | 6/1928 | France . | |
| 651150 | 3/1951 | United Kingdom . | |
| 870337 | 6/1961 | United Kingdom | 53/389 |
| 1464925 | 2/1977 | United Kingdom . | |

*Primary Examiner*—E. R. Kazenske
*Assistant Examiner*—Michael D. Folkerts
*Attorney, Agent, or Firm*—Cushman, Darby & Cushman

[57] ABSTRACT

An attachment for a newspaper rolling machine for applying a waterproof covering, preferably cling-type film, around the rolled newspaper. During the rolling of the newspaper (21), the web is fed into the nip of the partially rolled newspaper by the downward movement of pivoted feed arm (9) which grips the web by way of feed rollers (15, 16). Prior to the completion of the rolling action, the feed arm is pivoted upwards and pivoted lever (17) with hot wire cutter (18) pivots downwards to sever the web at a point so as to provide a sufficient length of web to completely envelope the rolled newspaper and maintain it in its rolled condition.

4 Claims, 5 Drawing Sheets

NEWSPAPER WRAPPING MACHINE

This is a continuation of Ser. No. 841,013 filed Mar. 17, 1986, now abandoned which is a continuation of Ser. No. 717,245 filed as PCT AU84/00136 on Jul. 16, 1984, published as WO85/00576 on Feb. 14, 1985, now abandoned.

This invention relates to a newspaper wrapping machine, more particularly to a machine for wrapping the newspaper in a waterproof material.

BACKGROUND OF THE INVENTION

At present newspapers are wrapped in a machine which applies a paper band around the middle of the newspaper, the band being adhered to itself by an adhesive. However during periods of inclement weather or when the newspaper is delivered by being thrown onto a wet lawn or garden, or wet path, the newspaper rapidly absorbs the moisture from the rain and from the wet areas on which it is lying. Thus this is very inconvenient to the householder and the newspaper has to be carefully unwrapped and dried before it is able to be read conveniently.

Australian Pat. No. 239865 discloses a machine for the wrapping of articles, such as bread or the like, the articles being moved and wrapped, the invention relating to the feed control of the wrapping material.

Australian Patent specification No. 13107/66 relates to a newspaper rolling and wrapping machine having a narrow paper web retained in position by adhesive to maintain the paper in a rolled condition.

It is an object of this invention to provide a wrapping machine which will provide a weather proof covering for the newspaper.

It is a further object of this invention to provide the wrapping or covering which will cover the entire outer surface of the rolled newspaper and which remains in place without the application of any adhesive or the like.

BRIEF STATEMENT OF THE INVENTION

Thus there is provided according to the invention a newspaper wrapping machine which includes a device or attachment for applying a waterproof covering over the entire wrapped and rolled newspaper.

Thus in a more particular form the newspaper wrapping machine includes an attachment for applying a waterproof material to the rolled newspaper, the attachment being fitted to a conventional rolling machine having rolling forks and pressure rollers to roll the paper, the wrapping machine including means to feed into the nip of the rolling paper in the initial period of rolling the newspaper a web of waterproof material, the device including means to sever the web at or prior to the completion of the rolling action, means being incorporated in or on the web to cause the web to be adhered to itself to maintain the paper in the rolled condition.

BRIEF DESCRIPTION OF THE DRAWINGS

In order to more fully describe the invention reference can be made to the attached drawings in which.

Figure 1:
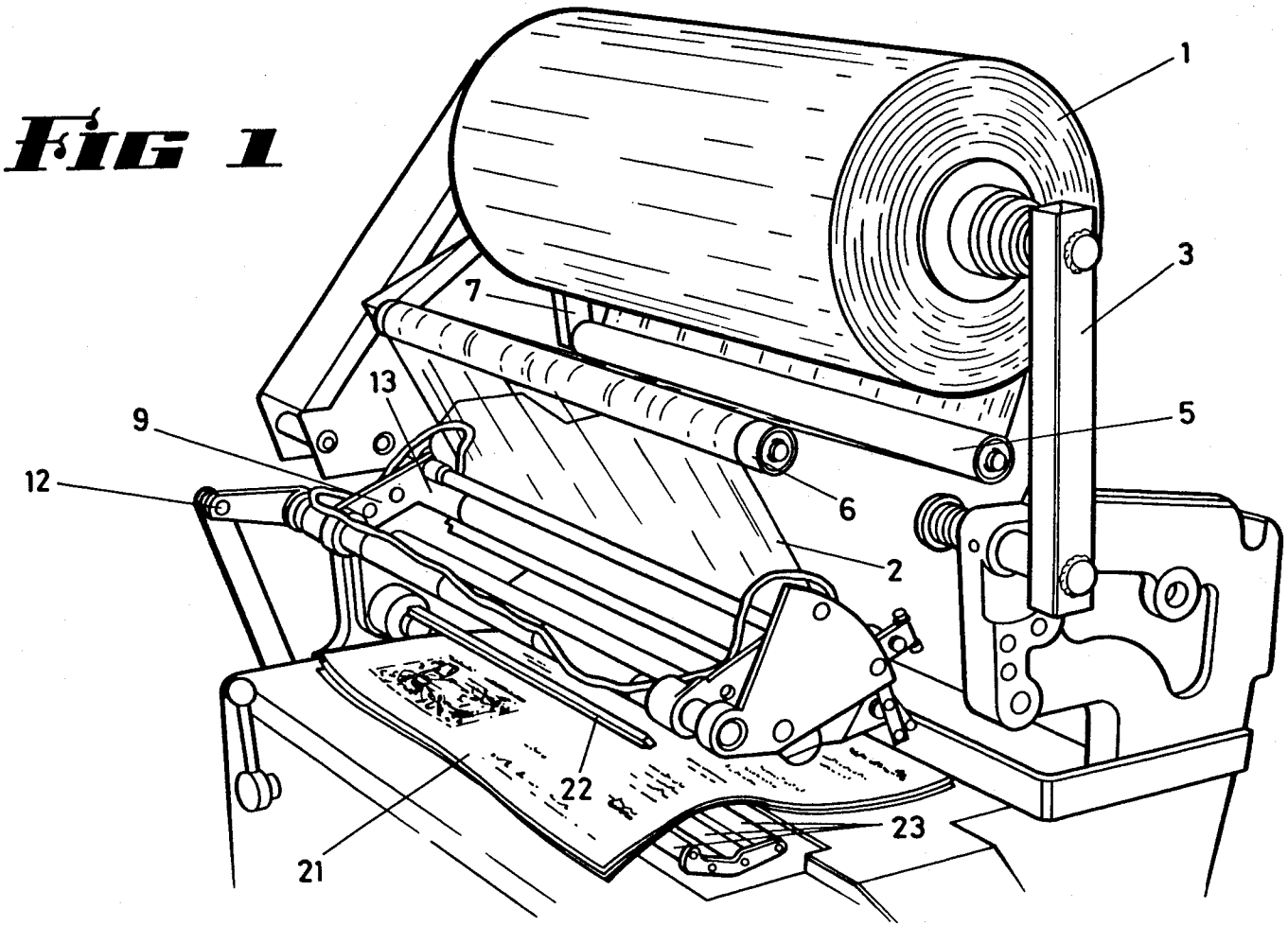
FIG. 1 is a perspective view of the wrapping machine.

The device is adapted to be attached to a conventional paper rolling machine with the craft paper feeding and gluing device being removed from the machine and the present invention being attached in place thereof.

In the FIGS. 2 to 5, only that portion of the conventional rolling machine which is necessary for the understanding of the invention is shown, the paper being inserted in position between the two rolling forks.

Preferably the waterproof material can be a plastic film, the film being of the type which will adhere to itself when contact is made between the two portions of the film.

As shown in the drawings a roll 1 of the film 2 is mounted on a supporting frame 3, the roll of film being freely rotatable on its mounting support, but a brake band 4 being provided to prevent undesired rotation.

The film passes over a pair of spring loaded dancing rolls 5, 6, dancing rolls 5 having an arm 7 to which is attached a member 8 to actuate the brake band. The spring loaded dancing rolls provide the required tension and in the stationary position, dancing rolls 5 maintains the brake 4 in the on position.

As the plastic web 2 is drawn from the roll 1, the tension in the web produced in the feeding operation will cause the dancing rolls 5,6 to move toward each other thus releasing the band brake 4 to allow further feeding to take place if desired.

The invention also includes a feed arm 9 which is pivoted to the supporting frame work 10, by pivot pin 11, the arm being actuated from one end 12 by a drive eccentric (not shown). The other end 13 is provided with a pivoted guide 14 and a pair of spring loaded feeding rollers 15,16. Roller 15 is provided with a spragg clutch to prevent reverse rotation of these rollers.

Also pivoted to the feed arm 9 is a lever 17 having hot wire cutter 18 which is spring loaded to the position away from its cutting position by a coil spring acting about pivot pin 19 and is maintained in its cutting position by the hot wire cutter lever 17 engaging a cutter cam roller 20.

Figure 2:
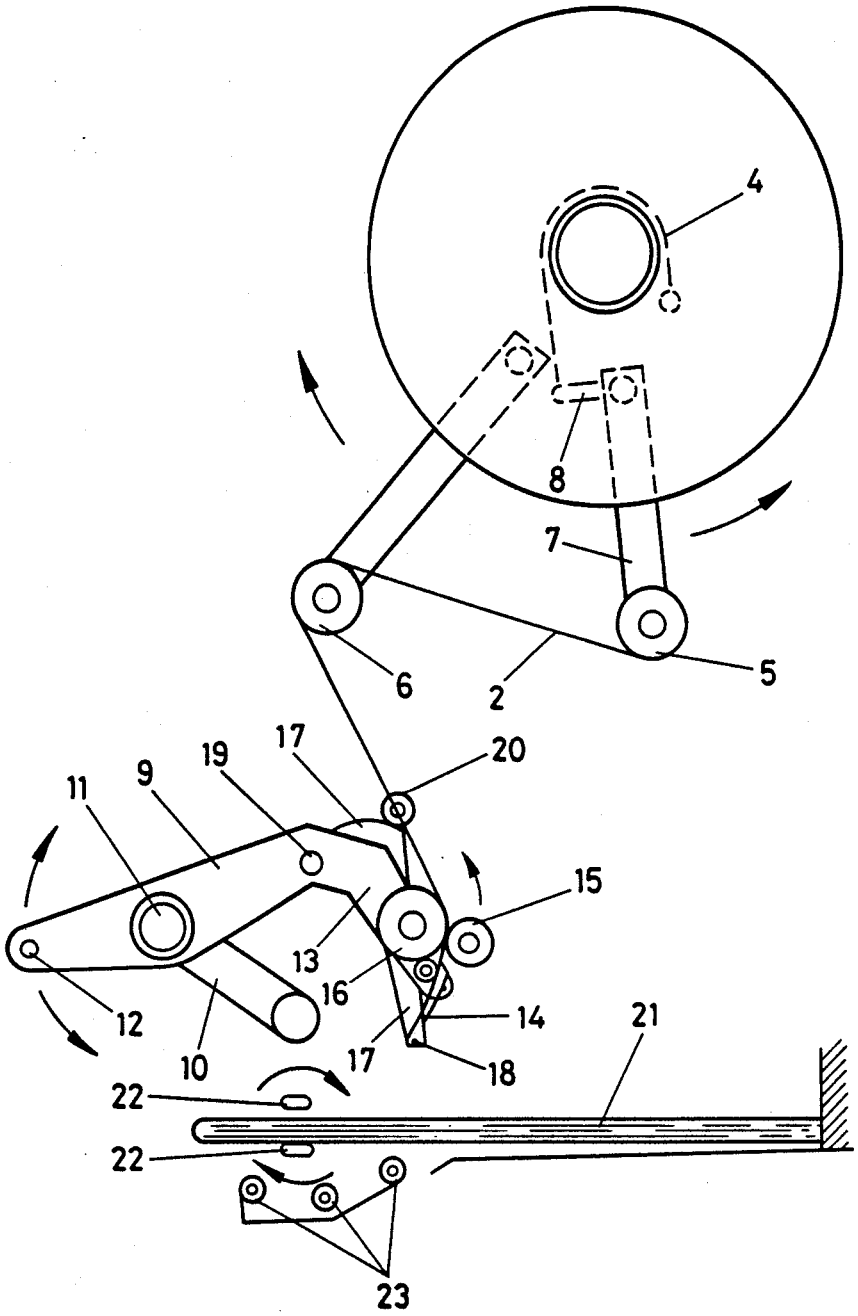
FIG. 2 is a diagrammatic view of the machine in the initial paper feed position.

As shown in FIG. 2 the paper 21 has been inserted between the rolling forks 22 ready for a rolling action.

Figure 3:
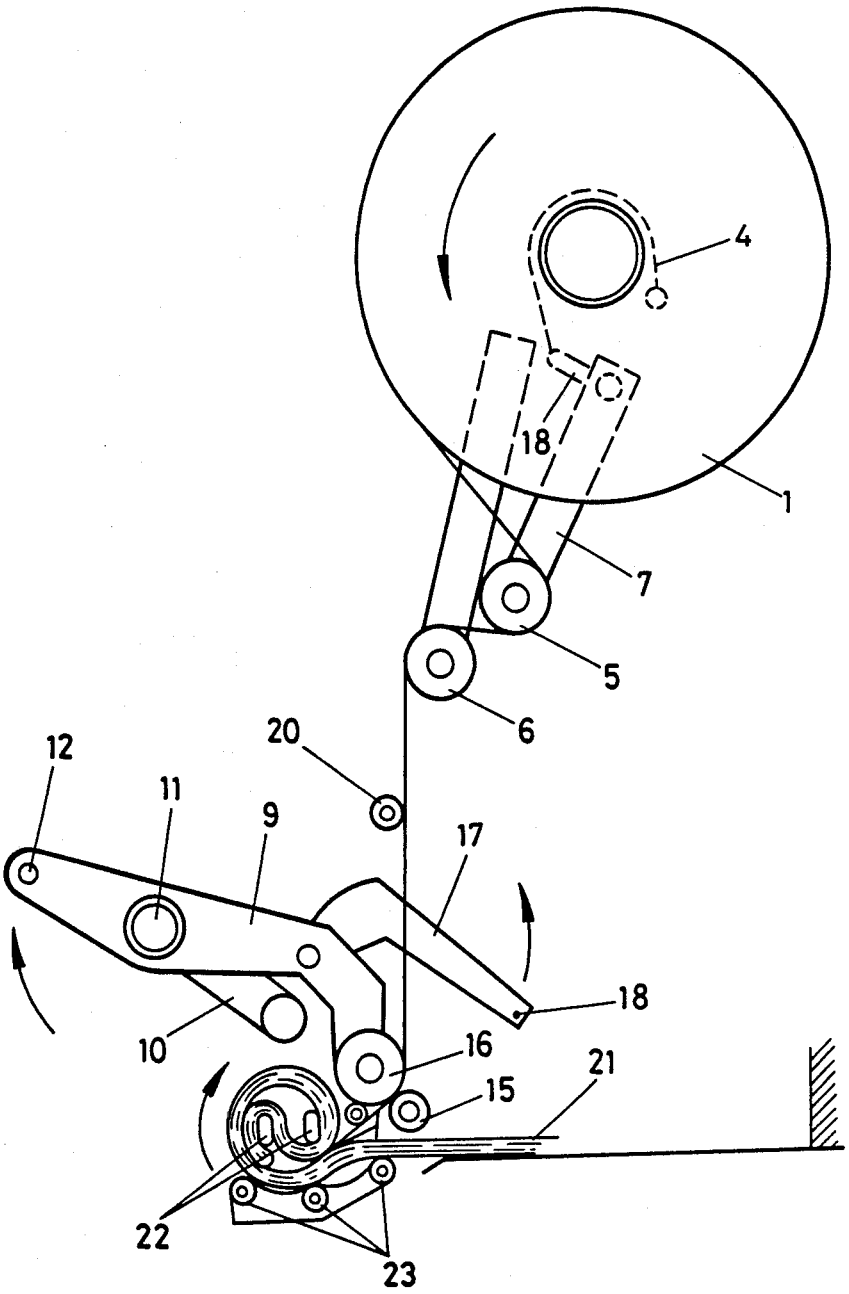
FIG. 3 is a diagrammatic view of the machine showing the rolling and wrapping feeding.

As shown in FIG. 3 the feed arm 9 is actuated to present the end of the web of film 2 into the nip between the rolling paper 21, and as the feed arm 9 moves downwardly to this position, the hot wire cutter lever 17 will move upwardly under the influence of its spring relative to the feed arm to a position as shown in FIG. 3. As the web 2 has been placed in the nip between the rolling paper, and as the paper rolls under the influence of the fingers 22 and pressure rollers 23, this rolling action will draw the web 2 through the feed rollers 15,16 and cause movement of the dancing rolls 5,6, the dancing roll movement supplying most of the web 2 for a wrap. At this time also the brake band 4 is released.

Figure 4:
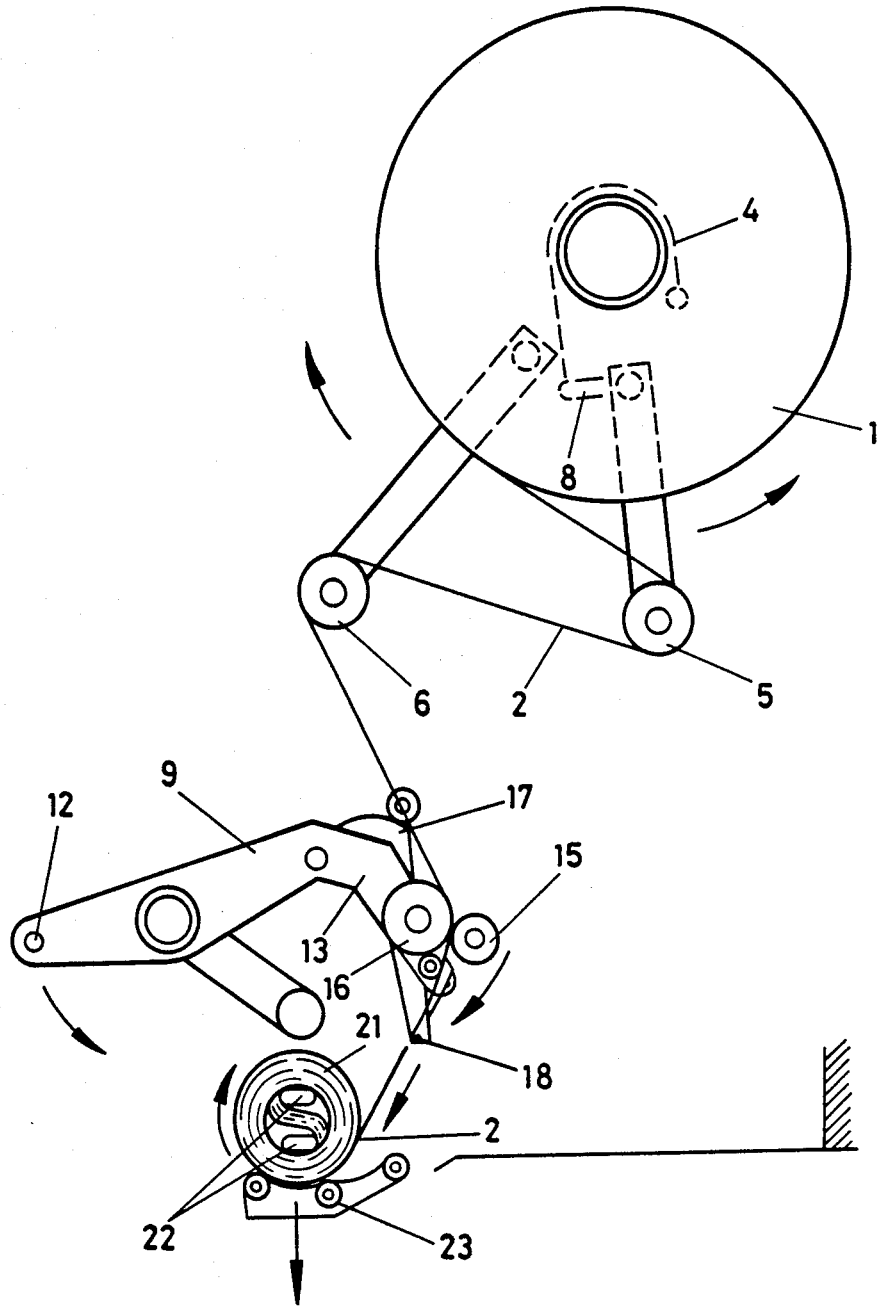
FIG. 4 is a diagrammatic view of the machine showing the cutting of the wrapping web.

Referring to FIG. 4 just prior to the final rolling actions of the rolling forks 22, the feed arm 9 is moved to its upper position and in so doing the hot wire cutter lever 17 will engage the cutter cam roller 20 to thus cause the hot wire lever 17 to move downwardly relative to the feed arm 9 and the web 2, and the hot wire 18 then cuts the web 2. Further rolling of the rolling forks 22 takes place and the paper 21 is then completely wrapped in the plastic film. The rolled paper is then ejected from the forks 22 in normal manner and a further paper is inserted between the rolling forks for the next action to take place.

It will be seen therefore according to the invention that the web of film 2 has a width at least equal to the width of the paper being rolled and is preferably extended over the ends of the rolled paper so that the web during handling and delivery would be to some extent folded over the end of the paper to protect the ends of the rolled newspaper from any excess moisture entering therein.

By the fact that the film of plastic is either treated or has incorporated thereinto in its composition a substance to cause the film to readily adhere to itself, the overlapped portions of the film on the wrapped paper have great sheer strength to thus maintain the paper in the rolled and wrapped condition.

The plastic film may be of the type which is readily available for wrapping foodstuffs and other products and which is readily used in the home for the covering and protection of foodstuffs, but preferably films are used which have greater strength and greater scuff resistance.

However, it has been found that often difficulty could arise in removing the plastic film wrap due to the fact that it is often difficult to locate the end of the film so that this can be grasped and peeled backwardly to remove the wrapping film. Also the film used does not have the ability to allow printing to take place on the film.

Thus, it is an object of this invention to incorporate with the wrapping material means whereby a facility is provided for the easy removal of the wrapping material, and it is a further object to provide means whereby printing can be incorporated if desired.

Figure 5:
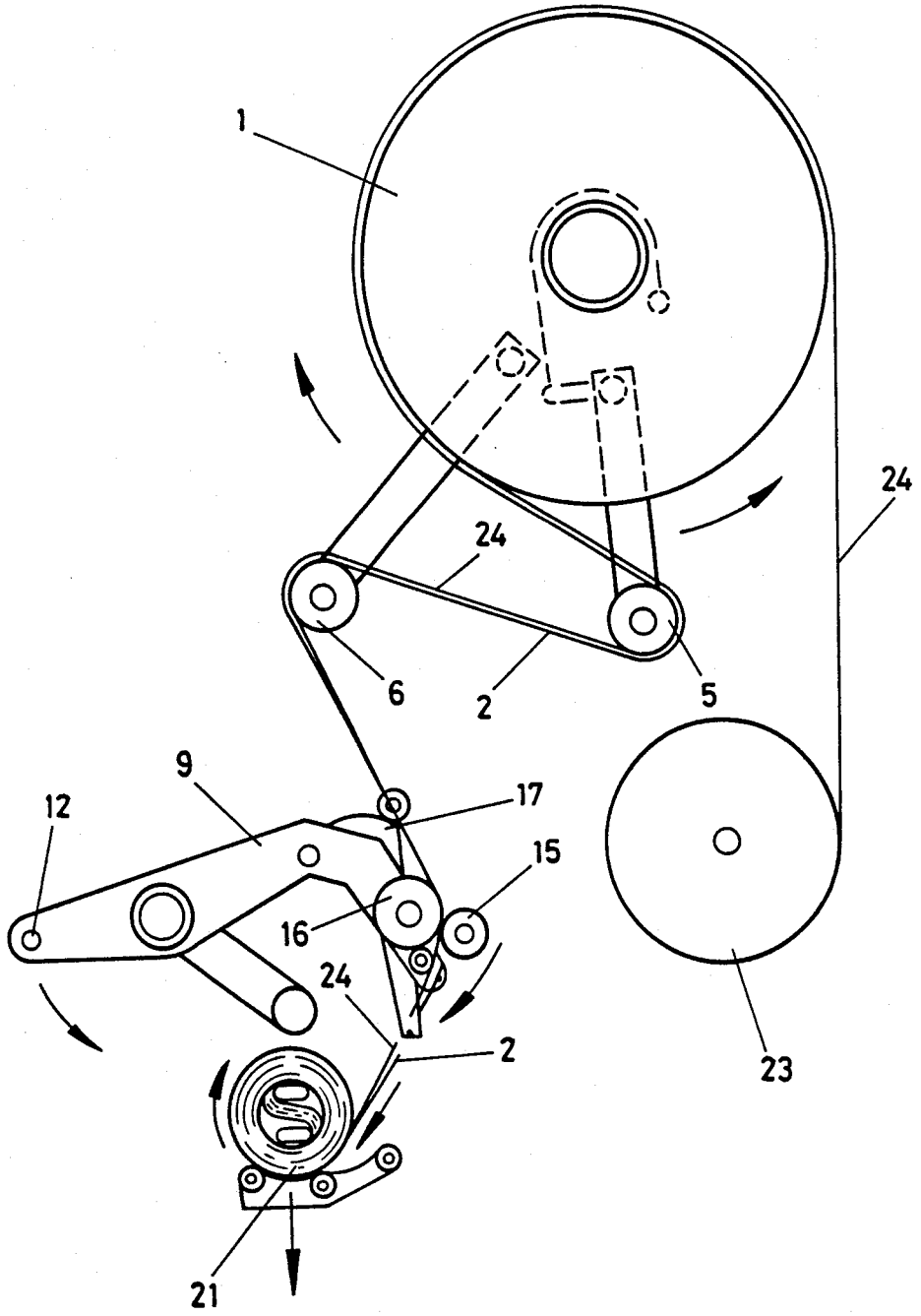
FIG. 5 is a diagrammatic view of the machine in a further embodiment.

In accordance with an improvementof the present invention as shown in FIG. 5, there is provided a further spool 23 mounted on the framework on the machine, the spool 23 carrying the filament or strip 24 to act as the removal means. This filament or strip passes upwardly over the reel 1 of web material 2 and thus passes with the web 2 over the dancing rolls 5,6 and through the feeding rolls 15,16 on the feed arm.

This is then fed in with the web material 2 into the paper being rolled.

Preferably the filament or strip 24 is of a plastics material and thus is cut with the web 2 by the hot wire cutter 18.

The reel 23 on which the filament or strip is mounted is adjustable by spring means or like to provide a tension to the filament or strip material being fed. This tension is preferably much less than the tension of the web material, which web material must have a relatively high tension in order to maintain the paper in the tightly rolled condition.

The filament or strip material thus passes with the web material but at a much lower tension and while it is being fed it is still able to slide slightly on the web material.

It is to be realised that the web material and the rolling action takes place at a relatively high speed and it has been found that when the two webs are cut with the hot wire cutter that firstly the web material is cut and then at a slightly later time the filament or strip material is cut thus leaving a small tab length 25 which can be grasped by the person unwrapping the newspaper.

It would appear that as the web material is of high tension it is immediately cut by the hot wire, but that the filament or strip material by being at a lower tension would bow or deflect sightly before the wire cuts this material, the bowing taking place apparently due to the lower tension to thus form a short tab length which can be grasped.

The length of the tab can be adjusted by the spool tension from which the strip of filament or strip material is fed so that by increasing the tension the tab length is reduced and conversely by reducing the tension the tab length is increased.

The strip material may be of any desired width, preferably in the order of twenty five millimeters and is desirably fed into the centre of the web material so that the strip would then be generally in the centre of the rolled newspaper.

This strip material may be of any suitable plastics material and may be coloured if desired.

Also this strip material is preferably such that it can readily take printing on it in any suitable colour so that advertising matter, the news vendors name, or any suitable greetings, such as Christmas messages or the like can be incorporated onto the strip material.

Although one form of the invention has been described in some detail it is to be realised that the invention is not to be limited thereto but can include various modifications falling within the spirit and scope of the invention.

I claim:

1. An attachment for a newspaper rolling machine to apply a weatherproof wrapping to a newspaper, the rolling machine having rolling forks and pressure rollers to roll the paper, characterized in that the attachment has mounting means to mount the attachment to the newspaper rolling machine, the attachment having supporting means to support a roll of the wrapping material, the wrapping material being of plastics material and adapted to adhere to itself when in contact with itself, pair of spring loaded dancing rollers to feed the wrapping material to spring loaded feed rollers mounted at one end of a pivoted feed arm to position the end of said wrapping material to the rolling forks and newspaper for rolling therewith, means for pivoting said feed arm to a feeding position adjacent said rolling forks, a spring loaded lever pivoted at one end on said feed arm adjacent said feed rollers, a hot wire cutter attached to the other end of said lever, spring means biasing said cutter end of said lever away from said feed rollers and the path of the wrapping material, a cutter cam fixed relative to the movement of said feed arm and said lever and adapted to be engaged by said lever, whereby when said feed arm is moved away from the feeding position the lever contacts said cam at a position on said lever intermediate said cutter and said pivoted end, and on further movement of said feed arm and said feed rollers the lever pivots against said spring to apply said hot wire cutter to said wrapping material to sever same.

2. An attachment for a newspaper rolling machine as in claim 1, characterized by means connecting one of said dancing rollers to a brake on said roll of wrapping material, to brake the roll of wrapping material when feeding is not required.

3. An attachment for a newspaper rolling machine as in claim 1, characterized in that upon said further movement of the feed arm after said contact between said lever and said cam the lever pivots about the point of contact with the cam to position the hot wire against the wrapping material.

4. An attachment for a newspaper rolling machine as in claim 1, including means to insert a removable strip into said wrapping forks with said wrapping material, said means including a roll for the removable strip, said strip passing through said dancing rollers and feed rollers with said wrapping material to be rolled and said strip being cut with said wrapping material by said cutter.

* * * * *